US008146211B2

(12) United States Patent
Shirai et al.

(10) Patent No.: US 8,146,211 B2
(45) Date of Patent: Apr. 3, 2012

(54) SLIDE ADJUSTER FOR BELT AND BUCKLE

(75) Inventors: Syoji Shirai, Tokyo (JP); Kouhei Musha, Tokyo (JP)

(73) Assignee: Builmatel Co., Ltd., Tokyo (JP)

( * ) Notice: Subject to any disclaimer, the term of this patent is extended or adjusted under 35 U.S.C. 154(b) by 337 days.

(21) Appl. No.: 12/311,364

(22) PCT Filed: Oct. 2, 2007

(86) PCT No.: PCT/JP2007/069237

§ 371 (c)(1),
(2), (4) Date: Mar. 27, 2009

(87) PCT Pub. No.: WO2008/041688

PCT Pub. Date: Apr. 10, 2008

(65) Prior Publication Data

US 2010/0175232 A1 Jul. 15, 2010

(30) Foreign Application Priority Data

Oct. 4, 2006 (JP) ..... 2006-272873

(51) Int. Cl.
*B65D 63/00* (2006.01)
*A44B 11/24* (2006.01)
*A41F 9/02* (2006.01)

(52) U.S. Cl. ..... 24/16 PB; 24/191; 24/591.1; 24/594.1

(58) Field of Classification Search ..... 24/16 PB, 24/68 SK, 68 B, 68 E, 68 T, 191, 194, 591.1, 24/591.4; 2/416–419
See application file for complete search history.

(56) References Cited

U.S. PATENT DOCUMENTS

| | | | | |
|---|---|---|---|---|
| 83,087 | A * | 10/1868 | Payne | 54/27 |
| 2,802,248 | A * | 8/1957 | Wallace | 24/68 B |
| 4,624,034 | A * | 11/1986 | Ishiguro et al. | 24/641 |
| 4,955,115 | A * | 9/1990 | Tanaka | 24/641 |
| 6,457,210 | B1 * | 10/2002 | Shirai et al. | 24/16 PB |
| 7,246,383 | B2 * | 7/2007 | Musal | 2/418 |
| 2005/0262618 | A1 * | 12/2005 | Musal | 2/417 |

FOREIGN PATENT DOCUMENTS

| | | |
|---|---|---|
| JP | H11-262408 | 9/1999 |
| JP | 2001-204518 | 7/2001 |

* cited by examiner

*Primary Examiner* — Robert J Sandy
*Assistant Examiner* — Tyler Johnson
(74) *Attorney, Agent, or Firm* — Manabu Kanesaka

(57) ABSTRACT

A slide adjuster includes a belt having engagement grooves in a form of saw teeth, and a buckle for receiving the belt therein in a forward direction and preventing the belt in the buckle from moving in a backward direction. The buckle includes a buckle body, and an operating plate disposed above a bottom plate and including an engagement claw projecting toward the bottom plate to engage one of the engagement grooves of the belt. The buckle body further includes restricting members projecting inwardly from two side plates thereof, and the operating plate includes recessed portions for receiving the restricting members therein without connecting thereto to prevent an accidental pressing force from being applied in a vertical direction to the operating plate.

3 Claims, 3 Drawing Sheets

SLIDE ADJUSTER FOR BELT AND BUCKLE

BACKGROUND OF THE INVENTION

1. Field of the Invention

The present invention relates to a slide adjuster for enabling slide of a belt against a buckle to adjust a length of and fix the belt.

2. Description of the Related Art

There has been known a slide adjuster comprising a buckle and a belt, and the slide adjuster has the configuration in which an engagement groove is provided on the belt and a hook of the buckle is elastically engaged in this groove so that the hooked state can be released from time to time according to the necessity.

The present inventors proposed in JP 2000-135103A (Patent document 1) an easy-to-produce and light weight buckle made of synthetic resin, and the buckle has a buckle body comprising a bottom plate and a ceiling frame opposite to each other and two side plates for connection between the bottom plate and the ceiling frame and an internal space for insertion of a belt having an engagement groove; and an operating plate which is horizontally placed inside the ceiling frame and has an engagement claw provided on a bottom surface of an end portion thereof and capable of being engaged in the engagement groove of the belt with a top surface at another end portion thereof to be pressed down. When the operating plate is linked to each of two opposite edges of the ceiling frame at an intermediate point between the engagement claw and the pressed section, the operating plate can freely be swung at the intermediate point as a fulcrum. Furthermore, a pair of hooking projections is provided on an external surface of the belt and on the ceiling frame, and the hooking projections make it possible to slide closer the belt with finger tips of one hand.

The synthetic resin-made buckle is functionally very excellent, and is the best one as a buckle for a headband of a helmet, but there are still the needs for development of slide adjusters for a belt and a buckle which are used together with dresses such as hats, trousers, skirts and the like requiring an excellent appearance as an important factor, and the desired slide adjusters are required to have a light weight and a simple structure, and also to have a buckle section having an appearance not so visible. Especially, the desired slide adjusters are required to have a synthetic resin-made and single-peace simple structure.

In the synthetic resin made buckle disclosed in Patent document 1, the hooking projections enabling finger tip operations with one hand are provided on the ceiling frame constituting the buckle body, and therefore it is not easy to hide the buckle body from the external appearance of hats, trousers, and the like.

On the other hand, the present inventors disclosed a belt with a buckle enabling connection between two end portions of a belt in the circular state by inserting an end potion of the belt into a cylindrical buckle provided at another end portion of the belt and adjusting the circumferential length of the belt in JP 2001-204518A (Patent Document 2). In this belt with a buckle, an recessed portion for engagement having a saw teeth-like form is formed along an edge portion of the one end portion, and also a projecting portion for engagement is provided in the space for insertion inside the buckle body, and in the state where the projection portion for engagement and the recessed portion of engagement are hooked with each other, the one end portion of the belt can move forward but can not move backward in the insertion space. Furthermore, a guide is provided at a position at least close to the projecting section for engagement in the insertion space for restricting swinging movement of the belt on a plain perpendicular to the direction in which the belt advances, and also an operating piece having the projecting section for engagement are provided substantially in the insertion space in parallel to the direction in which the belt advances, and the engagement between the recessed portion for engagement and the projecting portion for engagement can be released.

This belt with a buckle is well adapted to use as a slide adjuster for a wrist watch or the like because the buckle thickness can be made smaller, but the buckle section is completely exposed, and therefore the requirement as described above is not satisfied.

Patent document 1: JP 2000-135103 A

Patent document 2: JP 2001-204518 A

DISCLOSURE OF THE INVENTION

Problems to be Solved by the Invention

When it is tried to hide the buckle having an engagement release button inside a hat, a trouser, a skirt or the like for preventing the buckle from being exposed to outside, because engagement of the buckle body with the belt is released by adding a pressing force from a top surface to a bottom surface of the buckle body, when the operating plate other than the engagement release button is touched by a finger tip by accident, sometimes engagement between the buckle and the belt may be released.

The accidental disengagement can be prevented by covering the portion with a hood or the like, but in this case, it is impossible to monolithically mold the buckle structure.

The present inventors found that it was necessary to concentrate the hooking projection and the engagement release button at the end portion for preserving the slide adjusting function by a finger tip operation with one hand as well as for preventing the buckle from being exposed to the outside, and completed the present invention based on the finding.

Means for Solving the Problems

The present invention provides a slide adjuster for a belt and a buckle and the slide adjuster makes it possible for the belt to move toward the buckle but does not allow the belt to move away from the buckle in the hooking state where an engagement claw of the buckle is engaged in an engagement groove formed on an external surface of the belt and having a form like saw teeth. Furthermore, the buckle comprises a buckle body which has a bottom plate and a ceiling frame opposite to each other and two side plates for connection between the bottom plate and the ceiling frame and also which has an inside space used for insertion of the belt; and an operating plate which is horizontally placed within the ceiling frame and has the engagement claw provided on a bottom surface of an end portion thereof and capable of being engaged in the engagement groove of the belt and also which has a pressed section provided at the other end portion thereof for releasing the engagement. Furthermore the buckle has the configuration in which the operating plate is supported by a connecting shaft between the two side plates at an intermediate point between the engagement claw and the pressed section and can freely swing at the intermediate point as a fulcrum and also in which a pair of hooking projections is provided on an external surface of the belt and on the pressed section for enabling to pull the buckle and the belt closer to each other with finger tips of one hand.

The slide adjuster preferably has a restricting member provided on the buckle body for preventing a pressing force in the vertical direction from being directly added to portions other than the hooking projections.

The restricting member is preferably a thrusting portion of the buckle body which horizontally thrusts from the ceiling frame toward the operating plate.

A portion close to the end portion of the operating plate is preferably connected to at least one edge of the ceiling frame or to the two side plates opposite to each other.

Effects of the Inventions

With the slide adjuster according to a first aspect, especially because the hooking projection for operation with finger tips of one hand is provided as a release button at an end portion of the operating plate which is pressed downward, an operation for adjusting slide of the belt can be performed only with finger tips of one hand, and therefore not only an operation for engagement between the buckle and the belt can easily be carried out, but also the slide adjuster has fewer components as compared to those of conventional slide adjusters each for a belt and an buckle with the weight smaller than those of conventional ones, and also the production cost is lower than those for the conventional ones.

With the slide adjuster according to the first aspect, it is possible to hide the slide adjuster inside a hat, a trouser, a skirts, or the like for preventing the slide adjuster from being exposed to outside. To describe the feature more detailedly by referring to FIG. 3, a conventional belt with a buckle is worn between accessories 40, 40 of a dress and is visible to the outsides (Refer to FIG. 3(2)). On the other hand, with the slide adjuster according to the present invention, because a buckle 20 other than a hooking projection 15B can be accommodated inside the accessory 40 such as a hat, only a belt 10 and two hooking projections 15A, 15B are visible to the outside as an appearance of the hat, and therefore the appearance is little different from the belt 10 without any buckle (Refer to FIG. 3(1)). Furthermore, a slide section of the belt 10 is symmetrical in the horizontal direction, so that the appearance is simple, which contributes to increase of freedom in designing.

The restricting member is provided in the slide adjuster according to a second aspect, and therefore the buckle is never disengaged from the bent carelessly or accidentally.

The slide adjuster according to a third aspect has a structure which can be monolithically molded, and therefore the production is easy and the production cost is lower than the conventional ones.

In the slide adjuster according to a fourth aspect, resilience of the swinging operating plate is high, which ensures accurate and stable actions for engagement as well as for disengagement, which provides high reliability.

BRIEF DESCRIPTION OF THE DRAWINGS

FIG. 1(2) is a longitudinal cross-sectional view taken along the line z-z in FIG. 1(1);

FIG. 1(3) is a longitudinal cross-sectional view taken along the line z-z in FIG. 1(1);

BEST MODE FOR CARRYING OUT THE INVENTION

The best mode for carrying out a slide adjuster made of synthetic resin according to the present invention is described below with reference to the drawings.

Figure 1:
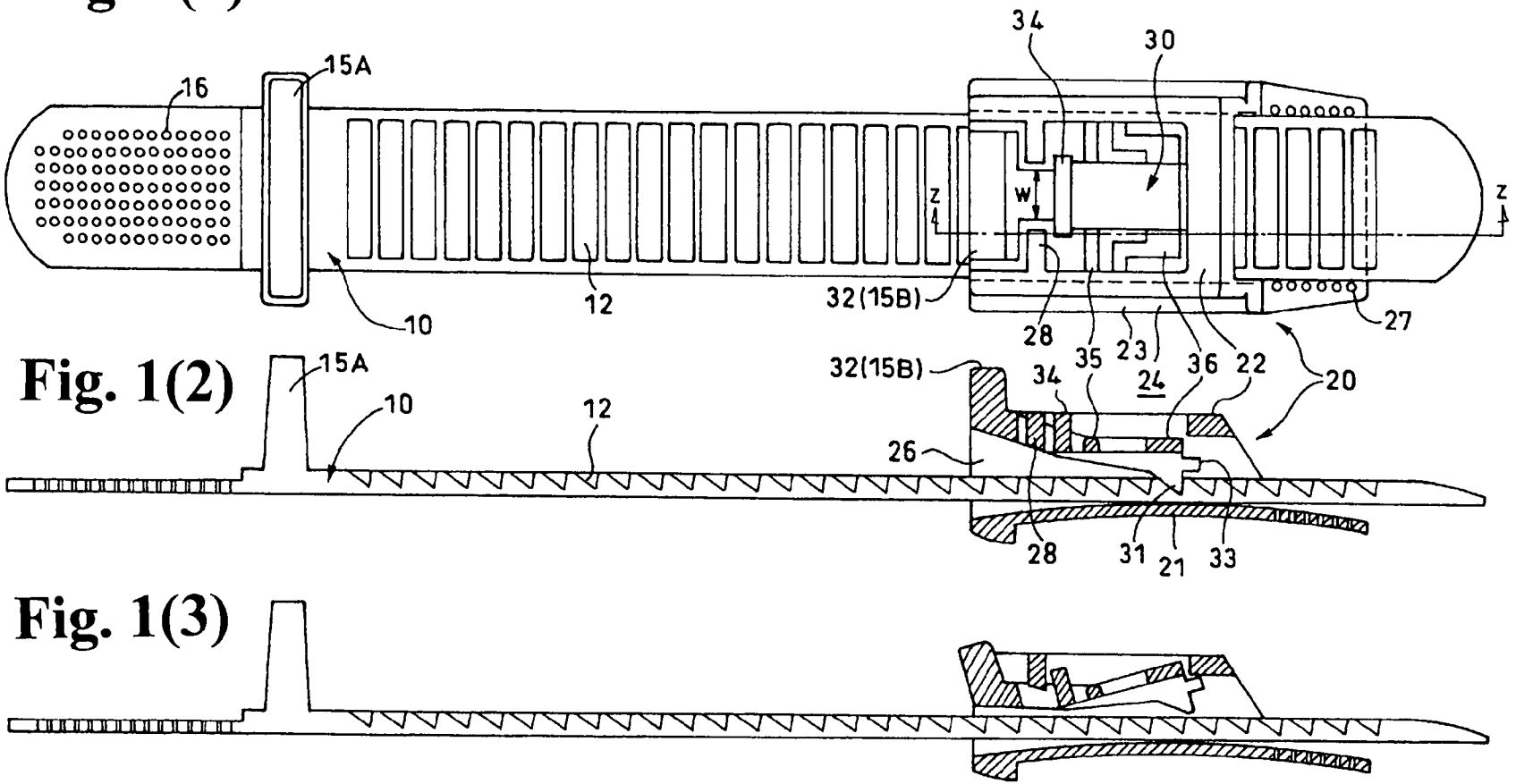
FIG. 1(1) is a flat view illustrating a slide adjuster according to the present invention.

FIG. 1 is a view illustrating a slide adjuster according to the present invention comprising a belt 10 and a buckle 20; and FIG. 1(1) is a flat view illustrating the slide adjuster, while FIG. 1(2) is a longitudinal side view taken along the line z-z in FIG. 1(1).

In the figures, an engagement groove 12 having a form like saw teeth is formed on an external surface of the belt 10 having a length, a width, and a thickness each previously specified according to the designing necessity, and extends from a tip (a portion close to a buckle 20) up to an end portion, and a hooking projection 15A having a size and a height allowing hook of a finger tip is provided at a portion close to the end of the engagement groove 12. Furthermore, a number of mounting holes 16 for fixing the belt 10 to a hat or the like not shown in the figure are provided in an area further closer to the end than the hooking projection 15A.

The buckle 20 has a flat and cylindrical buckle body 24 comprising a bottom plate 21, a ceiling frame 22 facing against the bottom plate 21, a side plates 23, 23 for connection between the bottom plate 21 and the ceiling frame 22. The buckle body 24 has an opening functioning as an insertion hole for the belt and provided in the side to which the belt 10 slides, and also has an internal space 26 functioning as an insertion space for the belt 10. In this embodiment of the present invention, because a length of the bottom plate 21 in the longitudinal direction (the sliding direction of the belt 10) is larger than a longitudinal direction of the ceiling frame 22, it is easy to attach to an article such as a hat the buckle 20 with a mounting hole 27 formed on the bottom plate 21, and also the belt 10 can smoothly be inserted.

An operating plate 30 having an appropriate size is horizontally provided inside the ceiling frame 22. An engagement claw 31 capable of being engaged in the engagement groove 12 of the belt 10 is provided in the projecting state on a bottom surface of an end portion of the operating plate 30, and a top surface 32 of the other end portion of the operating plate 30 functions as a portion to be pressed for disengagement.

A connecting shaft 35 is provided at an intermediate point of the operating plate 30 in the longitudinal direction, and the connecting shaft 35 is connected to upper portions of internal wall surfaces of the side plates 23, 23. A cross-sectional form of the connecting shaft 35 may be any of circular, oval, or other various forms. The connecting shaft 35 may have any form on the condition that the operating plate 30 can swingably supported and the operating plate 30 does not break even when swung repeatedly. It is to be noted that the connecting shaft 35 can achieve the same effects as those described below not only when connected to the side plates 23, 23, but also when connected to two edges of the ceiling frame 22 facing against the operating plate 30.

A hooking projection 15B is provided and projects upward at the other end portion (a pressed section 32) of the operating plate 30. Also the hooking projection 15B functions, like the hooking projection 15A provided on an external surface of the belt 10, for enabling a user to pull the belt 10 toward the buckle 20 with one hand by hooking the user's finger tip therein, and therefore the hooking projection 15B is required only to have a size enough for the user to set the user's finger tip therein. When the buckle 20 is used on a dress, a size of the hooking projections 15A or 15B may be as small as possible.

In the operating plate 30 according to the present invention, a lateral width W between the pressed section 32 and the connecting shaft 35 is set to as narrow a value as possible so long as the operating plate 30 can swing and the required strength is satisfied, and in the buckle body 24, the thrusting portions 28, 28 each as a restricting member thrust inward in the horizontal direction from the ceiling frames 22, 22.

This restricting member is a member for restricting a pressing force directly added in the vertical direction to sections other than the hooking projections 15B in the operating plate 30 in a portion of the operating plate 30 from the connecting shaft 35 to the hooking projection 15B, and because the portion is hid within the hat or the like, it is possible to miscellaneous operations cause by a finger tip when the hooking projection 15B is operated and to prevent the portion from being pressed down carelessly.

Figure 2:
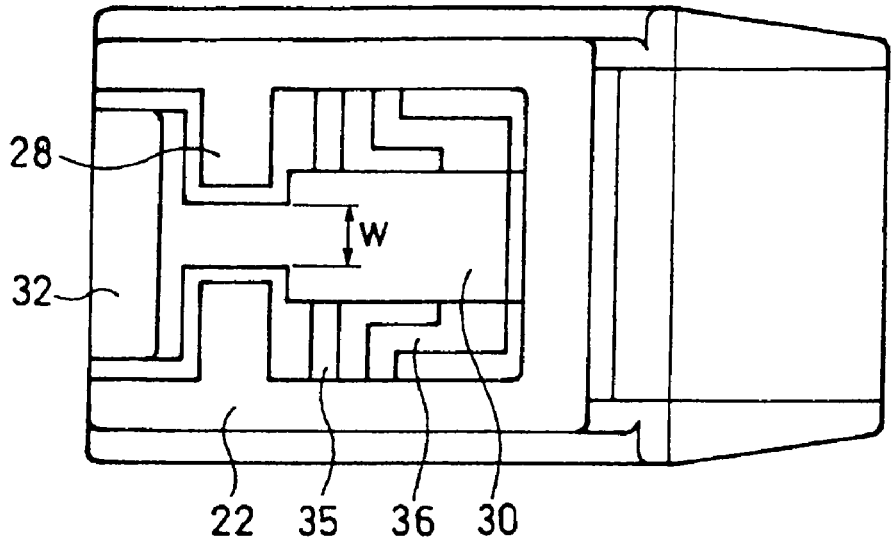
FIGS. 2(1) and 2(2) are flat views illustrating a variant of a buckle according to the present invention.
Figure 2:
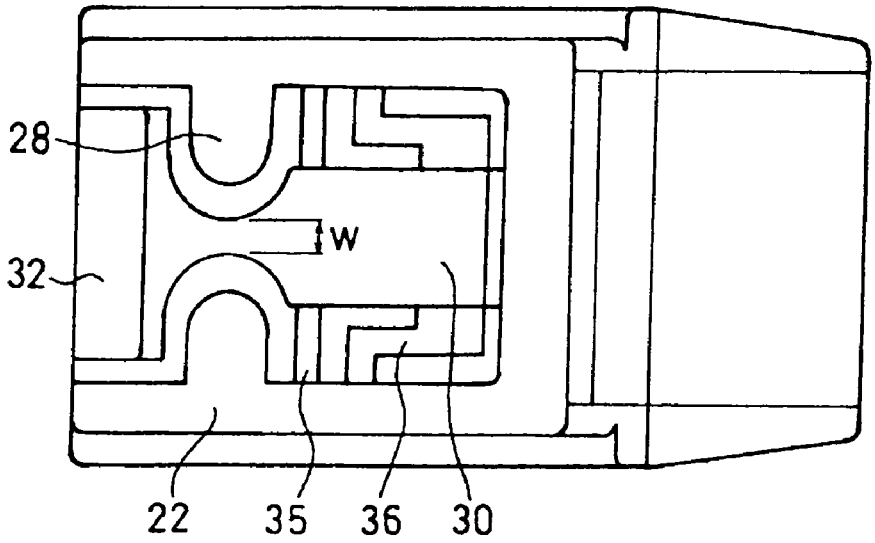
Figure 3:
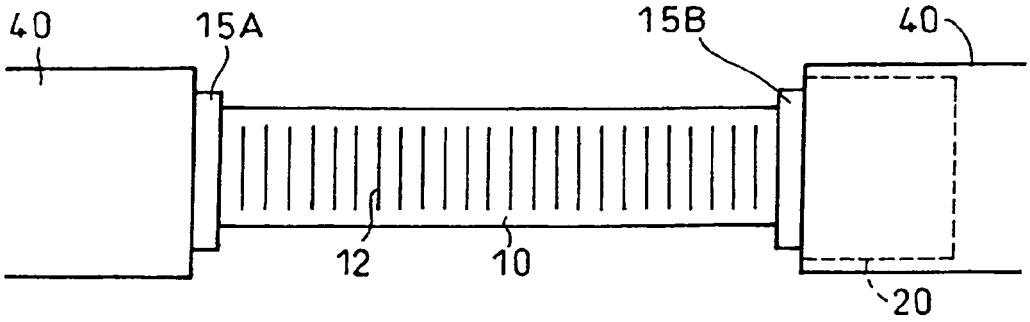
FIG. 3(1) is a front view showing an appearance of the slide adjuster according t the present invention when the slide adjuster is applied to a dress of the like, and FIG. 3(2) is a front view of a conventional slide adjuster.
Figure 3:
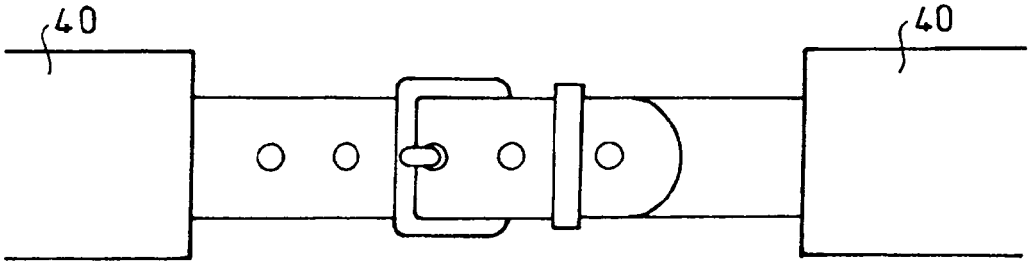
Fig. 3(2) Prior Art

Therefore, although the thrusting portions 28, 28 thrust in the horizontal direction as shown in the variant of the buckle 20 illustrated in FIG. 2, tips of the thrusting portions 28, 28 may be curved as shown in FIG. 2(2). In FIG. 2, the same reference numeral are used to denote the same components as those shown in FIG. 1, detailed description thereof is not made here.

In the embodiment shown in FIG. 1, end portions of the operating plate 30 (at each of which is provided the engagement claw 31) are connected to inner walls of the two side plates 23, 23. The connection is provided by bent connecting members 36, 36 extending from corner sections of the operating plate 30, and after the pressed section 32 is pressed down, the operating plate 30 can easily be restored to the original horizontal posture when a finger is detached from the pressed section 32. Therefore, a form of the connecting member 36 is not limited to that shown in the figure, and maybe other ones such as those like a waveform. In other words, the connecting member 36 functions as a damper for swinging actions of the operating plate 30.

As for connection between the operating plate 30 and the side plate 23, it is required only that the connection is made in a contrary side of the pressed section 32 with the connecting shaft 35 inbetween, and the connecting member 36 may be connected to a side edge of the operating plate 30 which is not included in the end portion of the operating plate 30, or to the ceiling plate 12 in place of the side plate 23.

A projection 33 provided at the end portion of the operating plate 30 (at which the engagement claw 31 is provided) functions as a stopper for preventing the hooking projection 15B provided on the operating plate 30 from being excessively pressed down during the disengaging operation.

Reference numeral 34 also denotes a stopper which contacts a side face of the thrusting portion 28 when the hooking projection 15B is pressed down (Refer to FIG. 1(3)) for preventing the operating plate 30 from being contacted to a top surface of the belt 10 when the hooking projection 15B is pressed excessively. In the present invention, it is required that only either one of the stoppers 33, 34 is provided, and in the embodiment shown in FIG. 2, the stopper 34 is not provided.

The buckle 20 is molded with flexible synthetic resin, and it is especially preferable to produce the buckle 20 with elastic synthetic resin such as polyacetal, polyoxymethylene, polyamide, and polycarbonate. This buckle 20 includes only a few components, and can easily be molded with a die monolithically.

Actions of the slide adjuster are described below. FIG. 1(2) illustrates the state in which the belt 10 has been inserted into the insertion space 26 of the buckle 20 and the engagement claw 31 of the buckle 20 is engaged in the engagement groove 12 formed on an external surface of the belt 10. A cross section of the engagement groove 12 in the sliding direction has a form like a saw tooth, and comprises a tapered face gradually becoming deeper in the direction in which the belt 10 advances and a wall surface extending substantially in the vertical direction from the deepest position.

When the belt 10 is inserted into the insertion space 26 of the buckle body 24 from the pressed section 32 (in the left side of FIG. 1(2)) and is moved forward, a top surface of the belt 10 contacts the engagement claw 31 of the operating plate 30, and the belt 10 moves forward pushing up the end portion of the operating plate 30 (in the side where the engagement claw 31 is formed), so that the position of the belt 10 for movement to or away from the buckle 20 is adjusted. In this state, the engagement claw 31 is engaged and hooked in the engagement groove 12 as shown in FIG. 1(2), and therefore the belt 10 can move forward freely to, but can not move away from the buckle 20.

On the other hand, when the pressed section 32 (or hooking projection 15B) of the operating plate 30 is lightly pressed down with a finger, the operating plate 30 rotates around the connecting shaft 35 as shown in FIG. 1(3), the engagement claw 31 positioned in the contrary side is raised and is disengaged from the engagement groove 12, so that the belt 10 can freely be slid, namely the belt 10 can be moved backward or pulled away from the buckle 20 freely. When the finger is released from the pressed section 32, the pressed section 32 restores the original position because of elasticity of the synthetic resin.

Utilizability For Industrial Purposes

The slide adjuster for a belt and a buckle according to the present invention can be applied to hats, trousers, skirts, accessories such as wrist watches, various types of helmets, shoes, and the like. Furthermore, the slide adjuster according to the present invention can be used as a tool for bundling by its nature.

The invention claimed is:

1. A slide adjuster, comprising:

a belt having engagement grooves in a form of saw teeth at one side thereof, and a buckle for receiving the belt therein in a forward direction and preventing the belt in the buckle from moving in a backward direction, wherein the buckle comprises:

a buckle body having a bottom plate, a ceiling frame formed above the bottom plate, and two side plates for connecting the bottom plate and the ceiling frame to form an internal space for insertion of the belt therein; and an operating plate disposed above the bottom plate adjacent the ceiling frame, and including an engagement claw projecting toward the bottom plate from a bottom surface at one lateral end portion thereof to engage one of the engagement grooves of the belt, a pressing section provided at a side opposite to the one end portion, and a connecting shaft for connecting the operating plate between the two side plates at an intermediate point between the engagement claw and the pressed section to swing around the intermediate point as a fulcrum, and wherein the buckle body further includes restricting members projecting inwardly from the two side plates, and the operating plate includes recessed portions for receiving the restricting members therein without connecting thereto to prevent an accidental pressing force from being applied in a vertical direction to the operating plate.

2. The slide adjuster according to claim 1, wherein the operating plate further includes a stopper formed at the one end portion to contact the ceiling frame when the pressing section is pressed excessively.

3. The slide adjuster according to claim 2, further comprising a pair of hooking projections provided on an external surface of the belt and the pressing section to pull the buckle and the belt closer to each other with finger tips of a user.

* * * * *